United States Patent [19]

Hamricke

[11] Patent Number: 5,014,975

[45] Date of Patent: May 14, 1991

[54] SIGNATURE DELIVERY AND STACKING APPARATUS

[75] Inventor: Kevin K. Hamricke, Des Moines, Iowa

[73] Assignee: Meredith/Burda Company, Des Moines, Iowa

[21] Appl. No.: 387,971

[22] Filed: Jul. 31, 1989

Related U.S. Application Data

[63] Continuation-in-part of Ser. No. 347,049, May 3, 1989, abandoned.

[51] Int. Cl.[5] ..... B65H 29/66

[52] U.S. Cl. ..... 271/202; 271/216; 271/303

[58] Field of Search ..... 271/198, 202, 213, 216, 271/270, 303; 198/461, 462

[56] References Cited

U.S. PATENT DOCUMENTS

| | | | |
|---|---|---|---|
| 2,852,256 | 9/1958 | Faulls, Jr. et al. | 271/202 |
| 3,595,564 | 7/1971 | DeYoung | 271/202 |
| 3,724,840 | 4/1973 | Kuckehermann | 271/270 |
| 4,285,513 | 8/1981 | Kwasnitza | 271/202 |
| 4,373,713 | 2/1983 | Loebach | 271/303 |
| 4,577,746 | 3/1986 | Tokuno et al. | 198/462 |
| 4,678,172 | 7/1987 | Faltin | 271/202 |
| 4,867,435 | 9/1989 | Cogswell et al. | 271/202 |

FOREIGN PATENT DOCUMENTS

| | | | |
|---|---|---|---|
| 0244650 | 4/1987 | European Pat. Off. . | |
| 244650 | 11/1987 | European Pat. Off. | 271/202 |
| 2022556 | 12/1979 | United Kingdom | 271/202 |
| 2059392 | 4/1981 | United Kingdom | 271/202 |

*Primary Examiner*—Robert P. Olszewski
*Assistant Examiner*—Steve Reim
*Attorney, Agent, or Firm*—Allegretti & Witcoff, Ltd.

[57] ABSTRACT

An improved signature delivery apparatus includes a mechanism for diverting signatures into a first series serially arranged dual conveyors or a second series of serially arranged conveyors. Each of the series of serially arranged conveyors are substantially identical in construction. The first series includes an assembly of opposed conveyor belts which engage the leading edge of each signature and reduces the speed of the signatures. Subsequently, the signature passes into an adjacent series of opposed conveyor belts where the signature is overlapped with the next succeeding signature and the speed of the signatures is reduced further. Two stage speed reduction of signature movement with stacking or overlapping of the signatures at the second stage permits significantly increased speed of press operation.

20 Claims, 3 Drawing Sheets

SIGNATURE DELIVERY AND STACKING APPARATUS

This is a continuation-in-part of application Ser. No. 07/347,049 filed May 3, 1989, and now abandoned.

BACKGROUND OF THE INVENTION

This invention relates an improved apparatus for receiving signatures from a printing press or the like, and for collating and stacking the signatures in an overlapping array.

A typical method of printing provides for a continuous web of paper to be printed in discrete, identical segments called signatures. After printing on the continuously web, the signatures are cut or separated one from the other, stacked and then delivered to subsequent stages in the process of manufacture of a newspaper, magazine or the like. Various mechanisms have been proposed for receipt of the printed web, cutting of the web into discrete signatures or sheets and stacking of the signatures. European Patent Application No. 0,244,650, published Nov. 11, 1987, discloses a sheet diverting and delivery system assigned to Littleton Industrial Consultants, which is designed, inter alia, to accomplish the objective of forming discrete signatures into a stack of signatures. That application is incorporated herewith by reference and constitutes prior art to the present invention.

The mechanism disclosed in the Littleton Industrial application depicts a web which is received between a series of rollers and which is cut into discrete lengths using a rotary cutter. The discrete lengths of the web are then fed into a diverter where alternate sheets are diverted to an upper and lower series of conveyors. The sheets received by the upper and lower series of conveyors are each conveyed at a reduced speed relative to the press web speed and are overlapped one on top of the other to form a stack of signatures. This is accomplished by means of a series of endless belts which convey and transport the sheets.

The prior art Littleton Industrial construction thus provides a single stage mechanism to slow the speed of the discrete, separate signatures and to stack or overlap them. The mechanism by which the signatures are delayed or slowed utilizes engagement of the trailing edge of the separate signatures. The construction allegedly provides for a maximum sheet flow rate of somewhere in the vicinity of 1600 to 1700 feet per minute. The Littleton Industrial construction thus does not accommodate the operation of modern presses at maximum press output. That is the construction disclosed by the Littleton Industrial application for patent has not been observed by applicant to be useful for final stacking or overlapping of signatures at full press speeds of modern presses which typically have an output of 60,000 or more impressions per hour and operating speeds of 2,000 feet per minute. Thus there is a need for an improved construction or apparatus for receipt of discrete signatures from a modern press operating at full capacity and for combining the signatures in an overlapped stack or array which moves at a speed less than full press speed.

BRIEF DESCRIPTION OF THE INVENTION

In a principle aspect the present invention comprises an improved signature delivery apparatus which includes a first conveyor that delivers a continuous series of serially arranged signatures into a diverter mechanism. The diverter mechanism alternately directs signatures either to a second conveyor stage or a parallel fourth conveyor stage. The second and fourth conveyor stages engage the leading edge of each signature and simultaneously reduce the speed of travel of each signature by up to 50 percent (50%) relative to the speed of the web from the press. The second and fourth conveyor stages each carry the alternately diverted signatures forward to a further speed reduction mechanism for the signatures. The further speed reduction and stacking or overlapping of the signatures is performed by third and fifth conveyor stage comprising a pathway continuation of the second and fourth stages respectively. The third and fifth stages also each receive the leading edge of each signature from the second and fourth stages respectively. As the leading edges are received a special cam mechanism insures that the signatures overlap as they move forward. In this manner, overlapping stacks of signatures ar created which move at a much reduced speed of conveyance relative to the press speed.

Thus with the apparatus of the present invention, the speed of the signatures is reduced by a first stage and a second stage slow down mechanism. With respect to the slowing down of each stage, the leading edge of each signature is engaged between endless belts. The endless belts are in opposed relation and converge one toward the other to thereby engage the leading edge of each signature. With the multiple stage arrangement of the present invention it is possible to form stacks of overlapping signatures printed on modern presses having a signature output of more than 60,000 impressions per hour.

Thus it is an object of the present invention to provide an improved apparatus for receipt of signatures from a high speed press and for slowing down the signatures to a reasonable conveyor speed for purposes of stacking and the like.

It is another object of the invention to provide an improved signature delivery apparatus which provides for uniform stacking of signatures in a partial overlapping array upon receipt of the signatures from a high speed press.

Yet another object of the invention is to provide a improved signature delivery apparatus which is easy to service, economical to manufacture and has a simplicity of construction relative to prior art systems.

Another object of the invention is to provide an improved signature delivery apparatus comprised of conveyors made up of opposed endless conveyor belts which converge toward one another to engage with the leading edge of signatures thereby transporting the signatures at a reduced speed into an overlapping, stacked array.

Yet another object of the invention is to provide an improved signature delivery apparatus which is useful over a wide range of press speeds and which is also useful in combination with diverter systems, signature cutting systems and web discharge systems without significant modification of such systems.

These and other objects and advantages and features of the invention will be set forth in the detailed description which follows.

BRIEF DESCRIPTION OF THE DRAWINGS

In the detailed description which follows reference will be made to the drawing comprised of the following figures.

DESCRIPTION OF THE PREFERRED EMBODIMENT

General Layout

Figure 1:
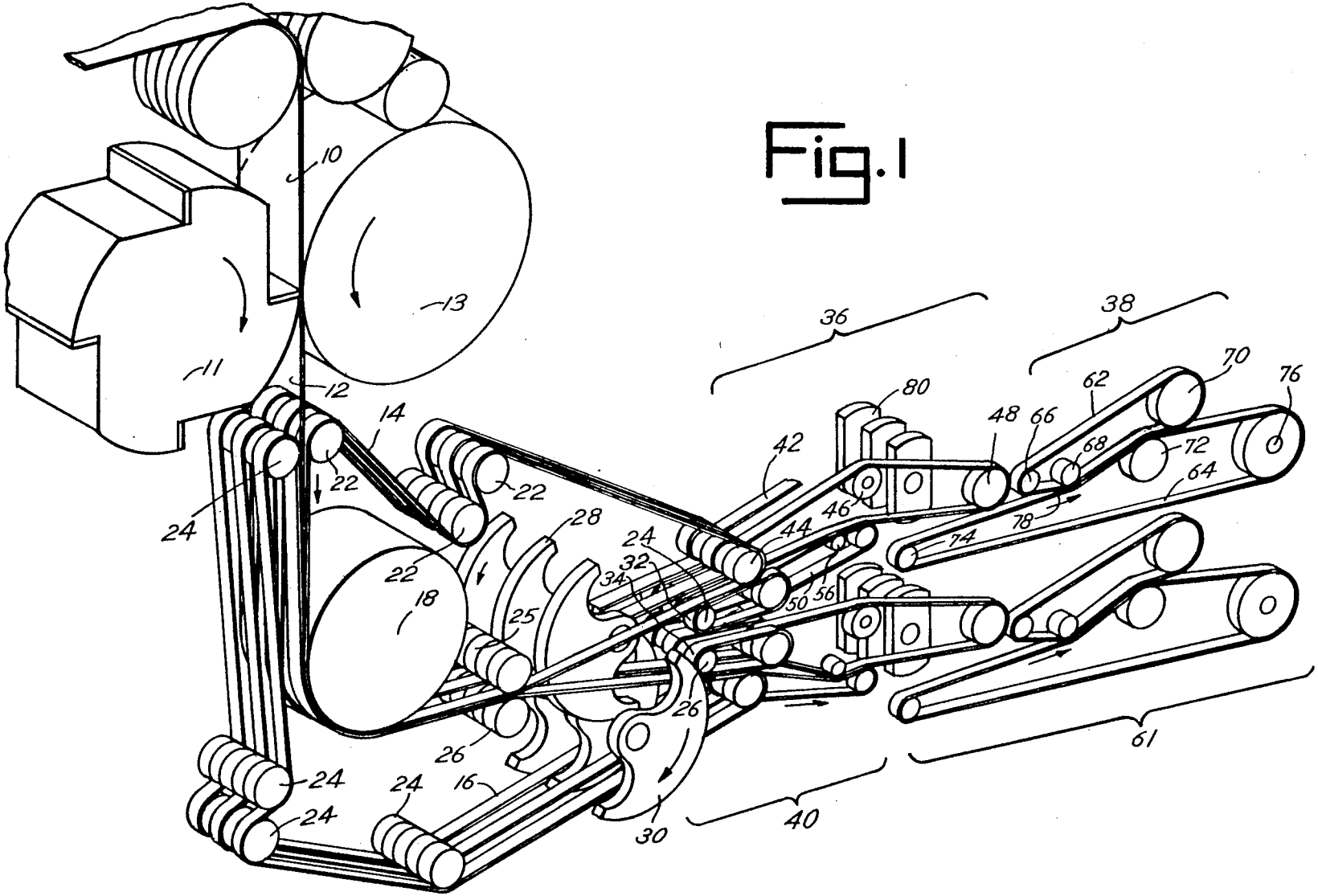
FIG. 1 is a perspective view of the web feed, signature diverter and signature delivery apparatus of the present invention wherein portions of the structure are removed in order to view the operation of the apparatus.

The present invention comprises an improved apparatus for moving and stacking sheets or signatures. The apparatus is thus especially useful in combination with a press from which an uncut web of paper is discharged and cut into discrete sheets or signatures on a continuous basis. The disclosure of an alternative mechanism is, as previously indicated set forth in greater detail in European Patent Application No. 0,244,650.

The following description of the invention is not limited. That is, the improved apparatus of the present invention may be incorporated with and associated with any type of web or sheet feed mechanism which feeds single sheets or signatures of material from a conveyor at high speeds for stacking one upon the other for discharge at a reduced speed.

Referring therefore to the FIGURES, a continuous web of paper 10 is fed from a press (not shown). That web 10 is then cut into discrete signatures or sheets 12 by means of a cooperating rotary cutter 11 and opposed rubber roller 13. In the embodiment of the invention, the discrete signatures 12 are carried end to end in successive serial order by opposed endless conveyor belts 14 and 16 or they may be slightly separated since belts 14,16 move at a higher speed than the web 10 in the preferred embodiment.

The belts 14 and 16 move in the direction of the arrows depicted in the FIGURES over a drive pulley 18 and a cooperative array of idler pulleys 22 and 24 associated with belts 14 and 16 respectfully. The belts 14 and 16 move forward at the speed of the press which may be upward of 2,000 feet per minute or at a speed which exceeds the speed of the press. However, the speed of the press is not a limiting feature of the invention.

The belts 14 and 16 are carried forward and diverge at two forward idler rollers 25 and 26. The opposed idler rollers 25 and 26 are positioned just upstream from first and second diverter discs 28 and 30 driven by drive shafts 29 and 31 respectively. The diverter discs 28 and 30 are described in the aforesaid Littleton Industrial European patent application and serve to engage alternate signatures 12 and direct the signatures 12 alternately either upwardly or downwardly along the path of the upper conveyor belt 14 or lower conveyor belt 16 respectively.

The upper conveyor belt 14 moves continuously at the press speed or greater and in cooperative relationship with an upper, driven belt 32 having the same speed to thereby convey the signatures 12 between the belt 32 and the belt 14 at the speed of the belts 14 and 32. Belt 32 is driven by roller or drive shaft 33. Note that adjacent signatures 12 transported by upper conveyor belts 14 and 32 are spaced from one another by a distance approximately equal to or greater than the length of a signature 12. In a similar fashion the lower belt 16 moves in cooperation with a lower driven, belt 34 to transport the spaced signatures 12 therebetween at press speed or greater.

The following description refers only to the upper driven array of belts 14 and 32 and the subsequent associated conveyor assemblies or stages. The upper belts 14 and 32 feed signatures 12 into a second conveyor stage generally depicted at 36. The second conveyor stage 36 subsequently feeds signatures 12 into a third conveyor stage generally at 38. The speed of the conveyor belts associated with a second conveyor stage 36 are typically somewhere in the vicinity of 60 percent (60%) of the speed of the belts 14 and 32 or thus about 65 percent (65%) of the press speed. However, the second stage 36 can be reduced to about 50 percent (50%) of the press speed.

The third conveyor stage 38 is comprised of belts which further reduce the signature 12 conveyance speed relative to the press speed. Third conveyor stage 38 speed is reduced approximately another forty to fifty percent (40% to 50%) relative to the second conveyor stage 36. Thus the final conveyance speed of signature 12 will be about one-quarter ($\frac{1}{4}$) to one-third ($\frac{1}{3}$) of the speed of discharge of signatures 12 from the press.

In review, referring, in general, to the second conveyor stage 36, the separate signatures 12 are spaced from one another by a distance depending upon the speed of the second conveyor stage 36 relative to press speed. The signatures 12 carried by the second stage 36 are preferably spaced slightly one from the other. The signatures 12 from the second conveyor stage 36 feed into the third conveyor stage 38 which operates at an even lesser speed than the second conveyor stage 36. Thus the signatures 12 are fed into the third stage 38 in such a fashion that they will overlap one on top of the other. The signatures 12 are then discharged in an overlapping array from the third stage 38.

Summing up, the signatures 12 pass through what is defined as a first conveyor stage made up of the belts 14 and 16 operating at or greater than press speed. They then go through a diverter (disc 28 and 30) where they are selectively positioned upwardly or downwardly. Using the upper pathway as an example, the signatures 12 are now spaced from one another and continue movement at press speed or greater on the conveyor belt 14 and auxiliary conveyor belt 32. The signatures 12 then go into the second conveyor stage 36 where their speed is reduced up to fifty percent (50%) and the signatures 12 remain spaced slightly one from the other. The signatures 12 then enter the third conveyor stage 38 where their speed of movement is further reduced by up to fifty percent (50%) and they are made to overlap.

The Second Conveyor Stage

The second conveyor stage 36 has a construction which is substantially identical to that of a fourth conveyor stage 40 associated with the lower conveyor belt 16. Fourth stage 40 is arranged parallel to second stage 36 and is directly below the second conveyor stage 36. The fourth conveyor stage 40 has a substantially identical construction to the second stage 36 and is adapted to receive the signatures 12 which pass downwardly to be carried by the belts 16 and 34. Referring therefore to the second conveyor stage 36, the description provided applies equally to the fourth conveyor stage 40.

The second conveyor stage 36 is comprised of an upper endless belt or belts 42 which pass over a series of three rollers 44, 46 and 48. Preferably roller 48 is a drive roller. Rollers 44 and 46 are idler rollers. The rollers 44, 46 and 48 guide the belts 42 in the direction indicated by the arrow.

Figure 2:
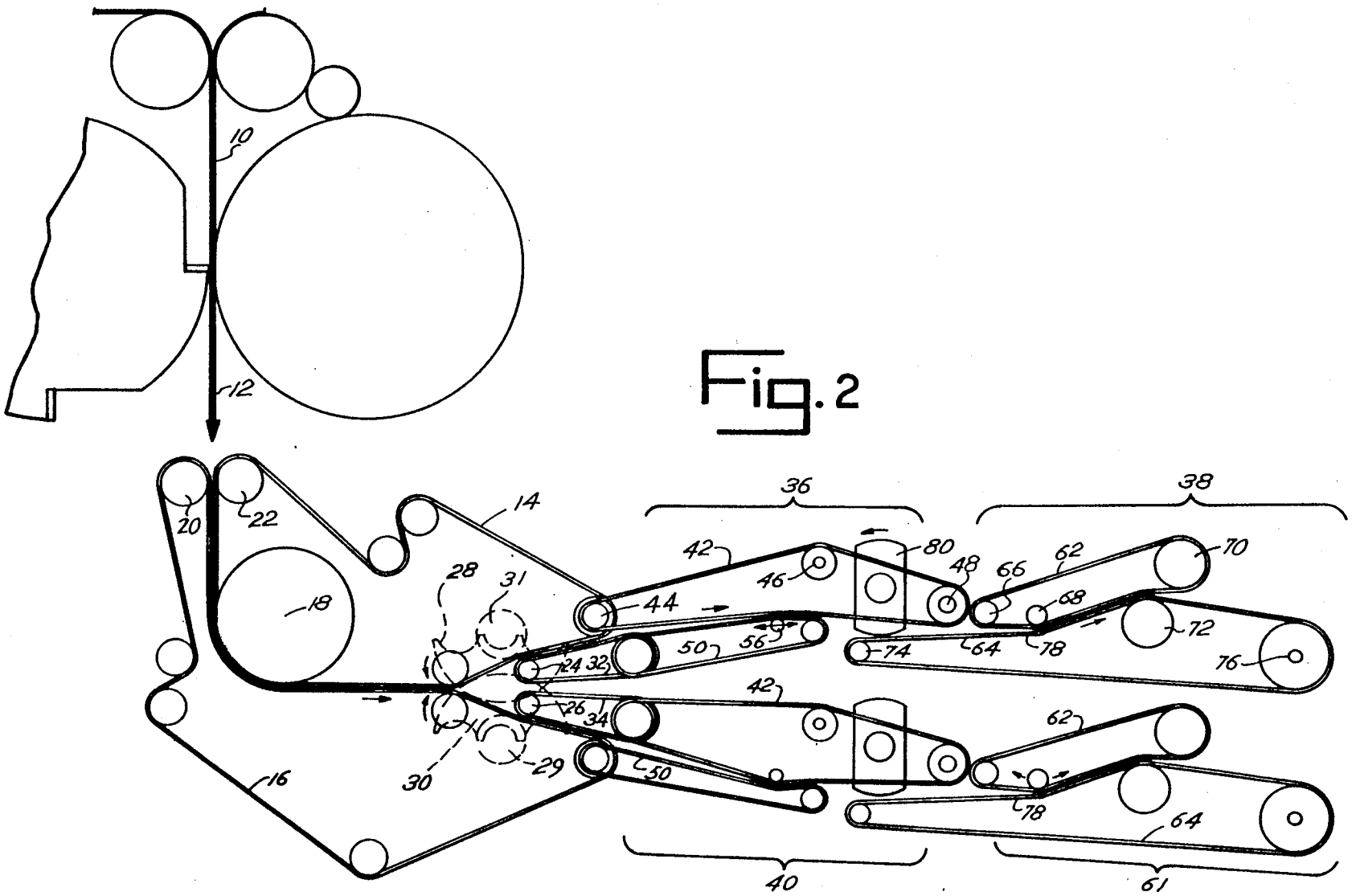
FIG. 2 is a side cross sectional view of the signature delivery apparatus of the invention depicting the array of various conveyor belts which comprise the apparatus.
Figure 3:
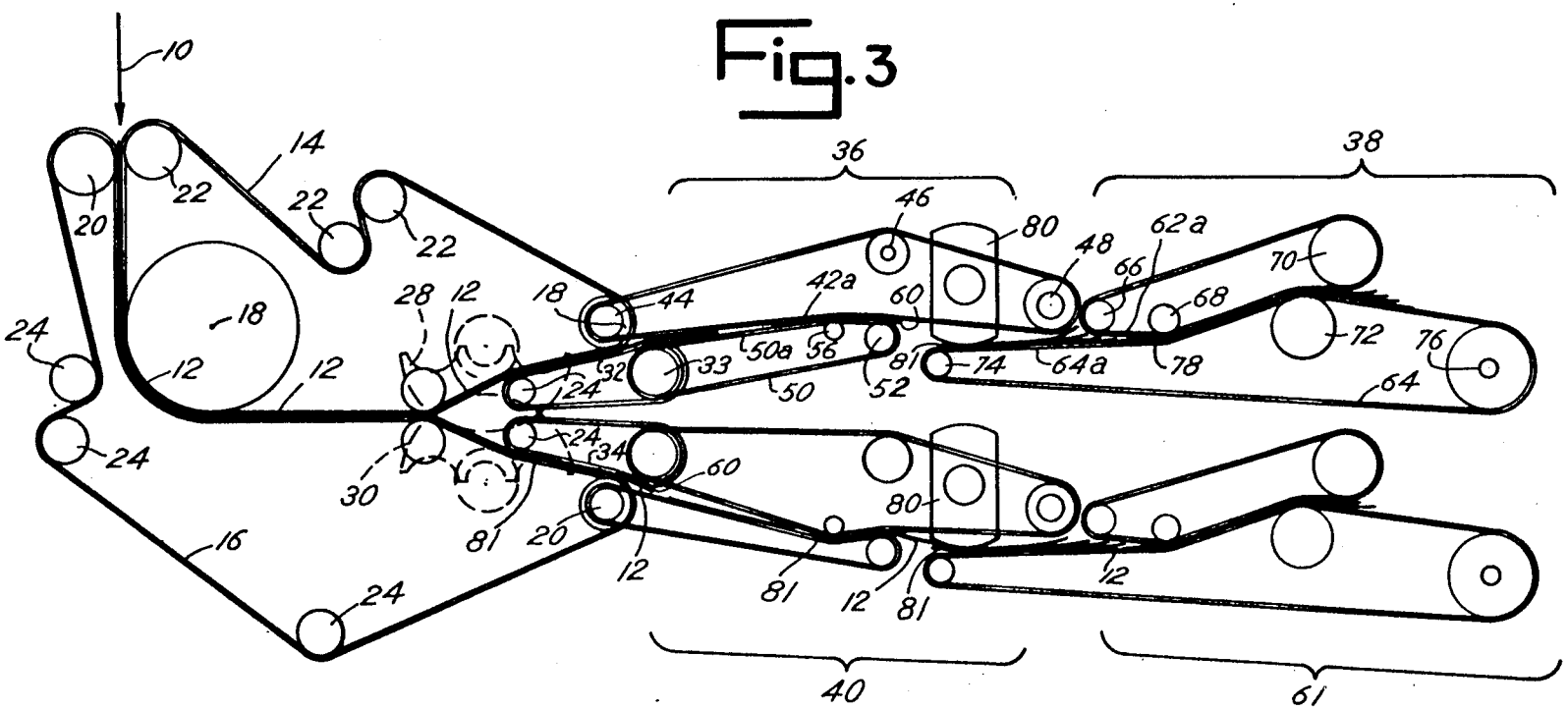
FIG. 3 is a diagrammatic view illustrating the manner in which successive signatures are delivered from the press into the array of conveyor belts comprising the apparatus and further depicts the speed reduction mechanism and signature stacking mechanism.
Figure 4B:
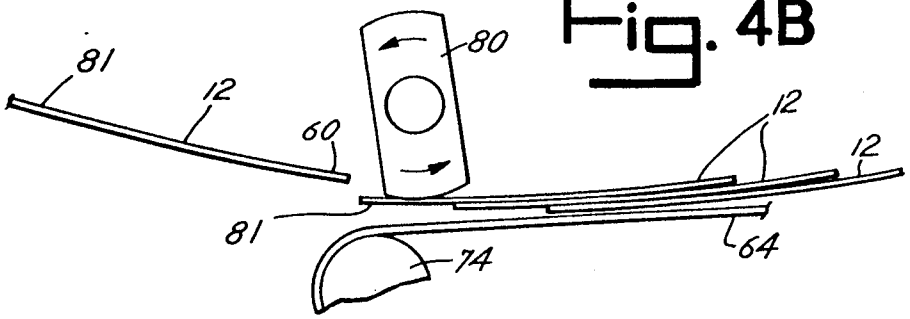
FIG. 4 is a series of diagrams illustrating the sequential steps of signature movement through the improved apparatus of the present invention.
Figure 4A:
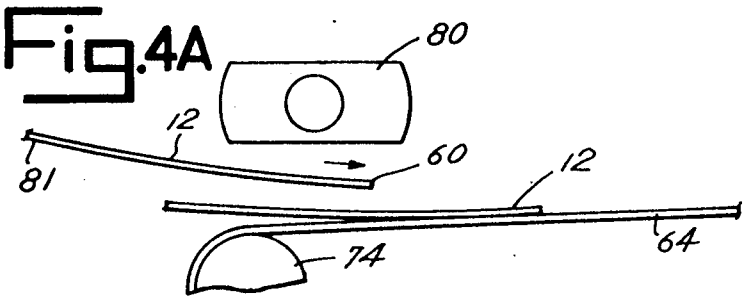

Positioned below the upper endless belts 42 are lower endless belts 50 which also move in the direction indicated by the arrow. The lower endless belts 50 are driven by the drive roller 52 in cooperation with idler roller 54. An adjustable idler roller 56 controls the spacing between the belts 42 and 50 and the length or distance from drive roller 33 to idler roller 56. Note roller 56 may be adjusted longitudinally as depicted by the arrows in FIG. 2 to adjust the spacing between roller 33 and roller 56. Preferably the spacing is equal to or greater than the length of a signature 12.

It is to be noted that the signature run of the belt 42; namely, run **42*a* opposes the signature run 50*a* of belt 50. The runs 42*a* and 50*a* converge toward one another in the direction of belt travel. The convergence begins in the region of the rollers 44 and 33 where the runs 42*a* and 50*a* are spaced and converge at the roller 56 sufficiently so that a leading edge 60 of signature 12 is physically engaged between the belt runs 42*a* and 50*a*. Also the roller 56 is positioned so that runs 42*a* and 50*a* define a dimension which permits receipt of a full signature 12 or nearly a full signature 12 before the signature 12 is gripped. The leading edge 60 will then be gripped to move forward at the speed of the runs 42*a* and 50*a***, a speed significantly less than press speed.

The signatures 12 are thus inserted between converging runs **42*a* and 50*a* at the press speed or greater. The leading edge 60 and thus the signature 12 slips or slides along the runs 42*a* and 50*a* for about the distance of the longitudinal dimension of the signature 12 until the leading edge 60 is, in fact, gripped between runs 50*a* and 42*a*. The entire signature 12 is then slowed down to the speed of the runs 42*a* and 50*a***.

Since the signatures 12 are spaced by at least the longitudinal dimensions of the signature 12 before entering the second stage 36, insertion of the sequential signatures 12 between the runs **42*a* and 50*a* will not jam or engage the signatures 12 one on top of the other. In fact, with the construction of the present invention by appropriately controlling the relative speeds of the belts 42 and 50, the signatures 12 move between the runs 42*a* and 50*a* in such a fashion that the spacing between adjacent signatures 12 is reduced to about two inches or less which is about ten to fifteen percent (10% to 15%) of the original spacing between the signatures before they enter the second stage 36. The separate signatures 12 are thus carried forward by the operation of the belts 42 and 50 in the forward direction from the web 10 and from the press. As the signatures 12 are then carried forward they move from the second conveyor stage 36 to the third conveyor stage 38**.

The Third Conveyor Stage

The companion fifth conveyor stage 61 is arranged below the third stage 38. The fifth conveyor stage 61 has substantially the identical construction as the third conveyor stage 38. Therefore the sam description will apply to both.

The third conveyor stage 38 is comprised of a pair of opposed endless belts 62 and 64. The upper endless belt 62 are cooperative with a series of rollers including rollers 66, idler roller 68 and drive roller 70. The lower endless belts 64 are cooperative with an idler roller 72, idler roller 74 and drive roller 76. Both the upper belts 62 and the lower belts 64 move in the direction indicated by the arrow to carry forward the signatures 12. The lower belt 64 includes a inwardly leading belt run **64*a* which is designed to receive signatures thereon for carrying of the signatures forward. The speed of the belts 62 and 64 is less than the speed of the prior belts 42 and 50 of the second stage 36. The speed may be on the average fifty to sixty percent (50–60%) less although the difference depends upon the total size of the signature, the press speed, the speed of the belts 42 and 50** and other factors such as length of belt, size of signature and the like.

In any event, the belts 62 and 64 move substantially at the same speed and in the direction indicated. The belts 64 and 62 are convergent with one another and converge toward the roller 68. The region near the roller 68 defines a nip 78 which causes the belts 62 and 64 to come sufficiently close together to tightly grip the leading edge 60 of signatures 12 passing therebetween so that the signatures 12 may be conveyed between the belts 62 and 64 forward from the third conveyor stage 36.

A continuously rotating cam 80 rotates on a driven shaft 82 in the direction of the arrow to force down the trailing edge 81 of signatures 12 as they move onto the belt 64. That is, as a first signature 12 is fed forward along and by the belts 42 and 50, the cam 80 is rotated out of an engaging position with a leading edge 60 of a signature 12. The leading edge 60 will then fit into the region 84 between the belts 62 and 64. The leading edge 60 will move forward toward the nip 78 where it is to be engaged and where it will slow significantly relative to the speed of belts 42 and 50. Then the speed of the signature 12 is determined by the belts 62 and 64. Simultaneously, the trailing edge 81 of the signature 12 is engaged by the cam surface 80 forcing the trailing edge 81 toward the belt 64.

After the trailing edge 81 of signature 12 is forced toward the belt 64, the cam 80 rotates out of position to enable the next signature 12, and more particularly the leading edge 60, to move forward over the surface of the prior signature 12 and into the region between the converging belt runs **62*a* and 64*a*. Each leading edge 60 moves forward and is ultimately engaged in the nip 78**.

The cam 80 continuously rotates to drive successive trailing edges 31 of signatures downward. This continues and the signatures 12 form a overlapping array with the leading edge 60 of each adjacent signature 12 spaced slightly apart and with the signatures 12 overlapping. The signatures 12 then move forward carried by the belt 64. They are ultimately discharged over the roller 76 onto some other conveyor or are delivered to some other equipment for further processing.

The fifth conveyor stage 61 is substantially identical in construction and operation to the third conveyor stage 38 in its receipt of signatures 12 from the fourth conveyor stage 40. Thus the same description applies.

Overall Operation

With the construction of the present invention, the signatures 12 are diverted either into the second or third conveyor stages 36 and 38 or the fourth and fifth conveyor stages 40 and 61 Diversion of signatures 12 thus alternates. In other words, alternate signatures 12 are diverted into the separate lines of serially arranged conveyor stages. As previously indicated the second and fourth stages 36 and 40 slow the separated signatures 12 by about sixty percent (60%) the press speed. The signatures 12 remain separated, however, in the second and fourth stages 36 and 40 with a slight gap therebetween. As the signatures 12 move to the third and fifth stages 38 and 61 respectively they again slow down by as much as fifty percent (50%) of the previous stage speed, and they are also made to overlap one over the other. The cam 80 forces the signatures 12 against the third stage belt arrangement to ensure that the signatures 12 will not jam into the region between the belts 62 and 64.

It is possible to vary the construction depicted. For example, the described third stage 38 could potentially be utilized as a single stage to provide overlapping signatures immediately from the press. Such an arrangement, however, is not preferred. Rather, the two stage speed reduction and stacking operation is preferred. Thus while there has been set forth a preferred embodiment, the invention is to be only limited by the following claims and equivalents.

What is claimed is:

1. An improved signature delivery apparatus for receipt of signatures at a relatively high speed and for reducing the speed of the signatures comprising, in combination:

(a) a first conveyor for delivering a continuous series of serially arranged signatures, said first conveyor having a signature discharge end for discharging signatures serially at the relatively high speed of the first conveyor;

(b) a first auxiliary conveyor aligned to receive signatures from the first conveyor at the same speed as that of the first conveyor;

(c) a second conveyor in general alignment with the discharge end of the first conveyor and in alignment with the first auxiliary conveyor to receive and transport signatures from the first auxiliary conveyor, said second conveyor having a reduced speed which is a fraction of the speed of the first conveyor;

(d) diverter means at the signature discharge end of the first conveyor for diverting selected signatures onto the first auxiliary conveyor for direction into the second conveyor as they are discharged from the first auxiliary conveyor; and (e) said second conveyor including means to initially engage only a leading edge of a signature from the first auxiliary conveyor to positively transport the signature only at the reduced speed of the second conveyor.

2. The system of claim 1 wherein the second conveyor includes a discharge end and also including:

a third conveyor in general alignment with the discharge end of the second conveyor to receive and transport a signature therefrom;

said third conveyor having a reduced speed which is a fraction of the speed of the second conveyor; and said third conveyor including means to initially engage only a leading edge of a signature from the second conveyor to positively transport the signature at the reduced speed of the third conveyor.

3. The system of claim 1 wherein the second conveyor slidably receives the signature from the first auxiliary conveyor at a rate substantially equal to the difference in speed between the first and second conveyors.

4. The system of claim 1 wherein the second conveyor is comprised of opposed conveyor belts which converge to positively engage and carry the signature after the leading edge thereof is engaged.

5. The system of claim 1 where in the second conveyor has a speed in the range of greater than 50% of the speed of the first conveyor but less than the speed of the first conveyor.

6. The system of claim 1 wherein each signature on the first conveyor has a generally uniform dimension in the direction of conveyor travel, and wherein the means to initially engage the leading edge of the signature are positioned from the discharge end of the first auxiliary conveyor at a distance equal to or greater than that dimension.

7. The system of claim 6 wherein the means to initially engage the leading edge of a signature comprises converging opposed conveyor belts which converge together in the direction of signature travel and which are spaced to engage the leading edge at the distance equal to or greater than the uniform signature dimension.

8. The system of claim 7 wherein both belts of the second conveyor have the same speed.

9. The system of claim 7 wherein both belts of the second conveyor have an equal speed in the range of greater than 50% of the speed of the first conveyor and less than the speed of the first conveyor.

10. The system of claim 1 in combination with means for cutting a web leading to the first conveyor into signatures.

11. The system of claim 2 wherein the diverter means comprise a plurality of oppositely rotating diverter cams.

12. The system of claim 2 wherein the third conveyor includes opposed conveyor belts for engaging the leading edge of a signature discharged from the second conveyor, and further including means for overlapping signatures discharged from the second conveyor to the third conveyor.

13. The system of claim 12 wherein said means for overlapping comprise means for depressing the trailing edge of a signature from the second conveyor to allow the leading edge of the succeeding signature to extend over the trailing edge of the preceding signature.

14. The system of claim 13 wherein the means for depressing comprise cam means for engaging the signatures.

15. The system of claim 12 wherein the opposed conveyor belts of the third conveyor converge to engage the leading edge of a signature.

16. The system of any of claims 1 through 15 in combination with a fourth conveyor in parallel with the second conveyor for receipt of non-selected signatures diverted by the diverter means from first conveyor.

17. The system of any of the claims 1 through 15 in combination with a fourth conveyor having a construction substantially identical to that of the second conveyor, said forth conveyor being aligned with the diverter means to receive non-selected signatures diverted by said diverter means from the first conveyor to the second conveyor.

18. The system of claim 2 in combination with a fourth conveyor having a construction substantially identical to that of the second conveyor and positioned for receipt of non-selected signatures, and a fifth conveyor substantially identical to the third conveyor and positioned for receipt of signatures from the fourth conveyor.

19. The system of claim 2 in combination with a second auxiliary conveyor positioned for receipt of non-selected signatures diverted by the diverter means from the first conveyor and operative at the same speed as the first conveyor for discharge of signatures to a fourth conveyor operating at a reduced speed and aligned relative to the second auxiliary conveyor.

20. The system of claim 1 wherein the first conveyor and the first auxiliary conveyor include at least one conveyor belt which is common to both the first conveyor and the first auxiliary conveyor.

* * * * *

UNITED STATES PATENT AND TRADEMARK OFFICE

CERTIFICATE OF CORRECTION

PATENT NO. : 5,014,975
DATED : May 14, 1991
INVENTOR(S) : Hamricke

It is certified that error appears in the above-indentified patent and that said Letters Patent is hereby corrected as shown below:

Title page, item [75], inventor: last name of the inventor's, should be spelled as "Hamrick"

Signed and Sealed this

First Day of November, 1994

*Attest:*

*Attesting Officer*

BRUCE LEHMAN

*Commissioner of Patents and Trademarks*